US006062419A

United States Patent [19]

Krüger et al.

[11] Patent Number: 6,062,419

[45] Date of Patent: May 16, 2000

[54] SPILL-PROTECTING DRINKING VESSEL TOP

[75] Inventors: Burkhard Krüger, Gerdau; Oliver Renelt, Hamburg, both of Germany

[73] Assignee: Swedish Gifts, Inc., N.H.

[21] Appl. No.: 09/210,170

[22] Filed: Dec. 11, 1998

[30] Foreign Application Priority Data

Dec. 20, 1997 [DE] Germany ..... 197 57 066

[51] Int. Cl.[7] ..... A47G 19/00

[52] U.S. Cl. ..... 220/711; 220/715; 222/514

[58] Field of Search ..... 220/711, 714, 220/715, 717, 203.07; 222/513, 514, 518

[56] References Cited

U.S. PATENT DOCUMENTS

| | | | |
|---|---|---|---|
| 2,622,420 | 12/1952 | Rice | 220/715 X |
| 2,756,740 | 7/1956 | Deane | 220/715 X |
| 3,268,123 | 8/1966 | Spatz | 222/514 X |
| 3,275,194 | 9/1966 | Moulder | 222/518 X |
| 4,099,642 | 7/1978 | Nergard | 220/715 |
| 4,212,408 | 7/1980 | Valenzona | 220/715 X |
| 5,542,670 | 8/1996 | Morano | 220/711 X |
| 5,875,941 | 3/1999 | Hsu | 220/715 X |

*Primary Examiner*—Steven Pollard
*Attorney, Agent, or Firm*—Fasth Law Offices; Rolf Fasth

[57] ABSTRACT

A spill-protecting top on a drinking vessel with an opening at a suction spout for drinking fluid, with which a fluid passage between the opening and the drinking vessel is blocked by a closure body of a valve, which is pressed by a spring element against the scaling seat in the fluid passage, and wherein the closure body comprises a projection which with an actuation section projects up to in the region of the opening, and which presses the closure body, on actuation of the actuation section from the outer side of the opening, away from its sealing seat against the effect of the spring element by which means the fluid passage between the opening and the drinking vessel is unblocked.

26 Claims, 3 Drawing Sheets

SPILL-PROTECTING DRINKING VESSEL TOP

Figure 1B:
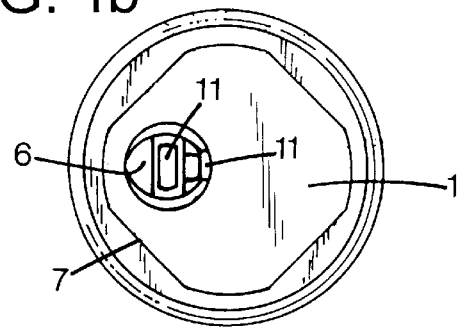

The invention relates to a spill-protecting top on a drinking vessel with an opening at a suction spout for drinking fluid from the drinking vessel.

Spill-protecting tops, which for babies or infants permit or simplify the drinking from a drinking vessel by sucking and which prevent the fluid from being spilled by way of an clumsy handling are already known. An example of this is the feeding bottle with a drinking teat of elastic material which permits the fluid passage through a small opening at the end of the nipple and an after-flow of air through a slot valve at the side of the nipple. For small children there are drinking vessels with rigid tops, in which valves for the fluid outlet and the air inlet are provided. The German utility model 29 00 819 relates to such a spill-protected drinking vessel which comprises slot membrane valves. The U.S. Pat. No. 5,079,013 on the other hand envisages valves whose spherical closure body is pressed by a spring opposite to the suction direction into a blocking position in the suction channel.

Furthermore there have become known drinking vessels with spill-protecting tops for sportsmen, which also in this field of application simplify the drinking and prevent spilling, e.g. when the sportsman moves or is exhausted. In bicycle sport, for this, bottles with tops are used which are provided with a slim suction spout. This is closed by a plug or a cap which must be removed before drinking.

The known drinking vessels have the disadvantage that their suction openings do not reliably close with fluid under pressure, wherein the pressure may be caused by carbon dioxide containing drinking fluid as well as external loadings with elastic drinking vessels. Inasmuch as before drinking a particular closure must be removed, the handling of a usual vessel is not favourable.

From U.S. Pat. No. 3,338,467 there is already known a closure cap operable by lips, which with a covering is scalingly pressed into the receiver of a usual fluid container. The cap above has an open, circular drinking edge, which has similar dimensions to a usual drinking glass or other drinking container. This edge encompasses a valve cap which has a surface part actuated by the lips, roughly at the same height as the drinking edge. The valve cap has a cylindrical body on whose lower end on a broadened base there is arranged a valve seal which cooperates with an inwardly directed valve seat of the closure cap. A helical spring loads the valve cap such that the seal is pressed against the seal seating, in order normally to effect a fluid-tight closure. The closure cap is dimensioned so large that the user may press his lower lip against the drinking edge and the upper lip against the valve cap, by which means the valve is opened. Furthermore by way of the distance from the valve seat to the drinking edge it is ensured that the flow of fluid between the valve seat and the drinking edge flows together to a narrower stream so that it does not run past at the edges of the mouth.

This top is very complicated and does not securely prevent the drink from laterally spilling at the mouth. In particularly suitable for the use by children. Furthermore the fluid may only flow out by its own weight and may not be sucked out which in particular with viscous fluid may be helpful.

Proceeding from this it is the object of the invention to provide a spill-protecting top on a drinking vessel, which also reliably prevents fluid under pressure from flowing out, which releases the fluid on placing on the mouth, which further reduces the danger of the drink running off laterally past the mouth and which permits a sucking of fluid from the drinking vessel.

The spill-protecting top according to the invention, on a drinking vessel, has an opening at a suction spout for drinking fluid. The suction spout may be completely encompassed by the mouth of the drinker so that no fluid exits laterally. A fluid passage between the opening and the drinking vessel is blocked by a closure body which is pressed by a spring element from the inside against the sealing seat in the fluid passage when the suction spout is not applied to the mouth. Fluid under pressure in the drinking vessel may support the pressing of the closure body against the opening. Carbon dioxide may thus not escape and the fluid containing this may not become flat. But also with a fluid not containing carbon dioxide and with a drinking vessel not under pressure the top prevents the unintentional spillage of fluid in a particularly reliable manner. Furthermore the closure body comprises a projection which with an actuation section protrudes up to in the region of the opening and which on actuation of the actuation section presses the closure body from the outer side of the opening against the effect of the spring element away from its sealing seat. The user may thus by actuating the actuation section with his teeth, lips, his palate or with his tongue, control the opening of the valve and the exit of fluid. A particular suction force does not need to be applied in many cases for the removal of fluid. This may flow out of the suction spout already in many cases on account of its own weight. Moreover the fluid may be sucked out of the vessel since this may be completely enclosed by the mouth. This is particularly advantageous for the consumption of viscous nutrition.

The opening may be formed at the free end of the suction spout. Preferably it is at least partly arranged laterally on the suction spout, wherein here it may be slot-shaped. Furthermore the projection may be rod-like and with the closure body blocking the fluid passage may intersect the slot-shaped opening at an acute angle. In particular with these formations the projection may be pivotable by actuation in the suction spout, in order to pivot the closure body with respect to the scaling seat. Preferably the projection protrudes out of the opening, in particular laterally. This permits the valve to be opened by merely biting, wherein the teeth or—e.g. with a baby—the palate actuates the laterally arranged actuation section.

Preferably the closure body is pressed against a circumferential sealing seat and the projection protrudes through the sealing seat. With this the closure body may be plate-shaped and at its circumference by pressed against the sealing seat. Moreover the closure body may be fixed to a lever which is mounted on the top. This is particularly advantageous in combination with a projection which is pivotable in the suction spout.

Advantageously the sealing seat is arranged on the inside on a floor carrying the suction spout on the outside in the region of the opening of the suction spout. The spring element acting on the closure element may rest on a fixed counter bearing. This may be fixed on the inner side of the floor by way of a sleeve-shaped retaining element or several rod-like retaining elements. Preferably the counter bearing is plate-shaped and is releasably fixed to the at least one retaining element. The spring element is preferably designed as a helical spring.

The projection may be formed from a body-compatible material, e.g. from PU, and without injurious edges, since it comes into contact with the mouth of the user.

Preferably the top comprises a cap which prevents the actuation section from being unintentionally actuated. The cap may be relesably seated on a shoulder of the top. Furthermore the drinking vessel in the region of the floor may comprise a shoulder onto which the cap may be releasably fixed on drinking. By way of this it is prevented that the cap gets lost, the inside of the cap is protected from contamination and the drinking vessel has an enlarged standing surface.

The drinking vessel may be shaped in many ways. It may be a beaker, a glass, a bag, a bottle or a tin, wherein the top sealingly closes the drinking vessel by way of a suitable connection. For this the top may be formed as a screw lid, a plug or cap e.g. with an elastic circumferential wall. Also a clamp strap connection, as is applied with preserving jars is possible. The sealing closure between the exit and the drinking vessel may be ensured in that either a sealing lip and/or a seal is located between the top and the drinking vessel or in that the surface of the top itself, which is in contact with the drinking vessel, is formed of sealing material. For this e.g. elastic plastic or rubber are considered. The top, the cap and the drinking vessel may in particular be formed of plastic. Also the top and the drinking vessel may be formed integrally. This may be carried out in combination with the resiliently impinged closure body as an injection moulded single-trip package.

Figure 1A:
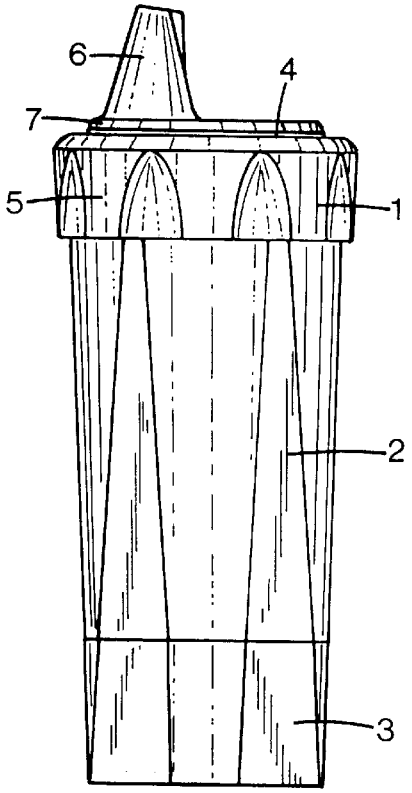
Figure 2:
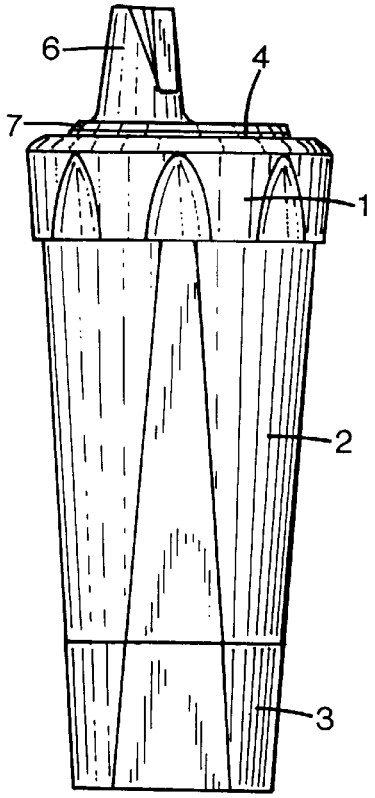
Figure 1C:
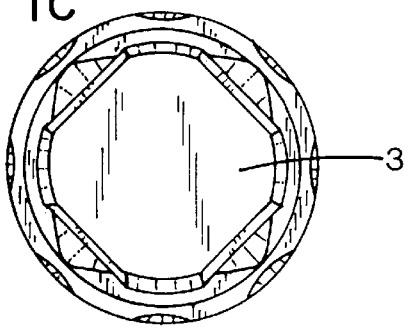
Figure 3B:
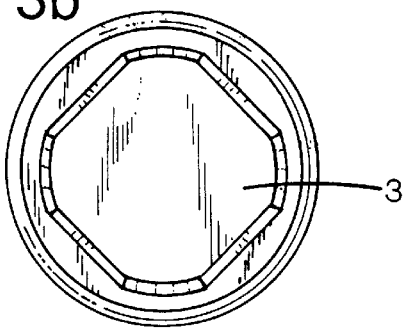
Figure 3A:
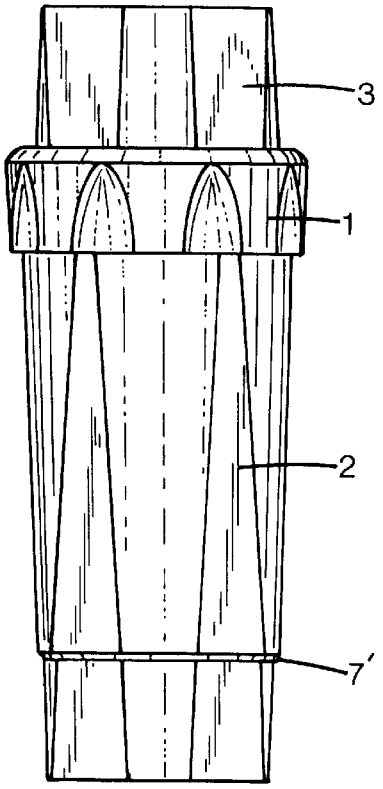
Figure 4:
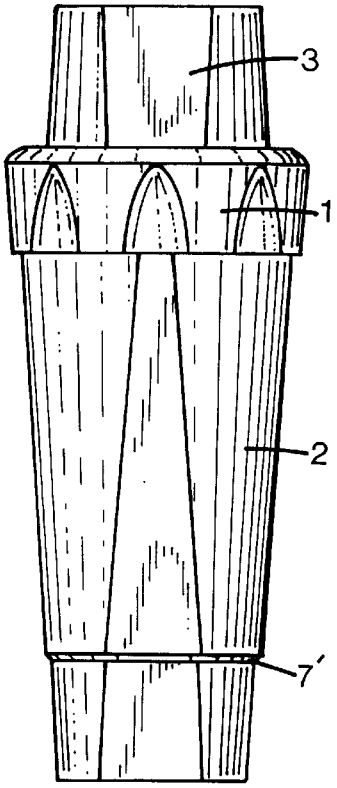
Figure 3C:
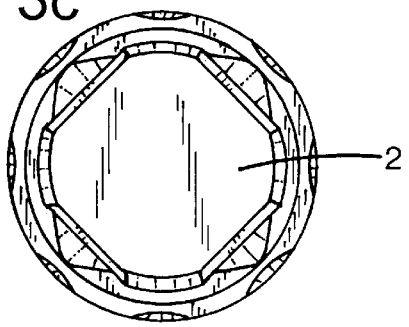
Figure 5:
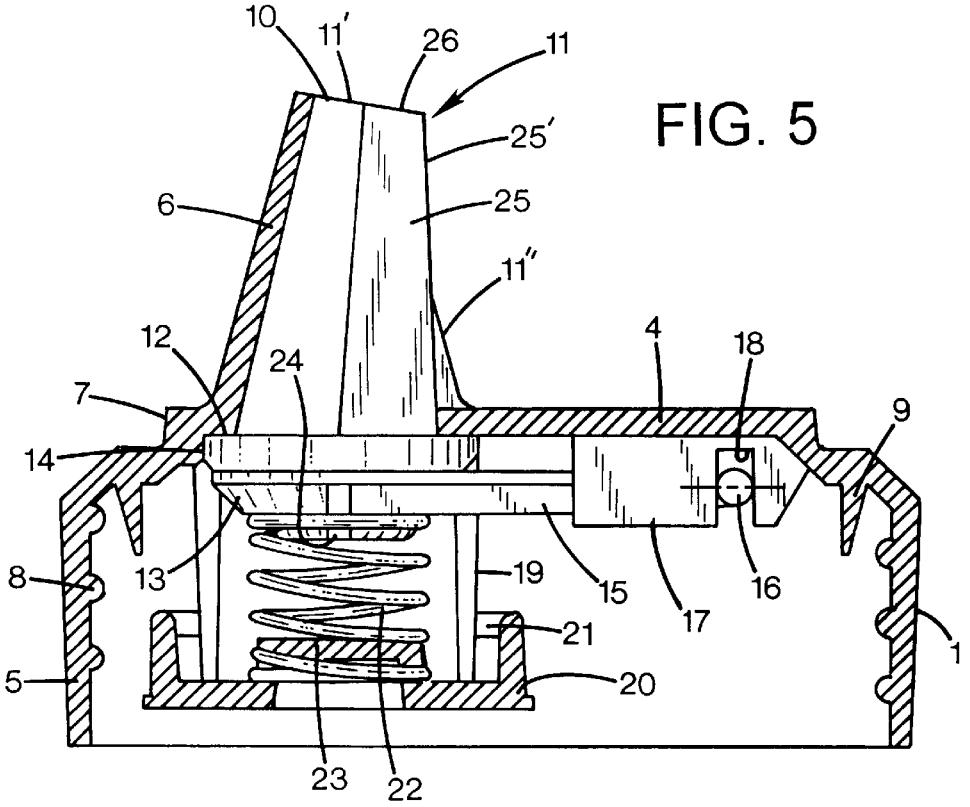
Figure 6:
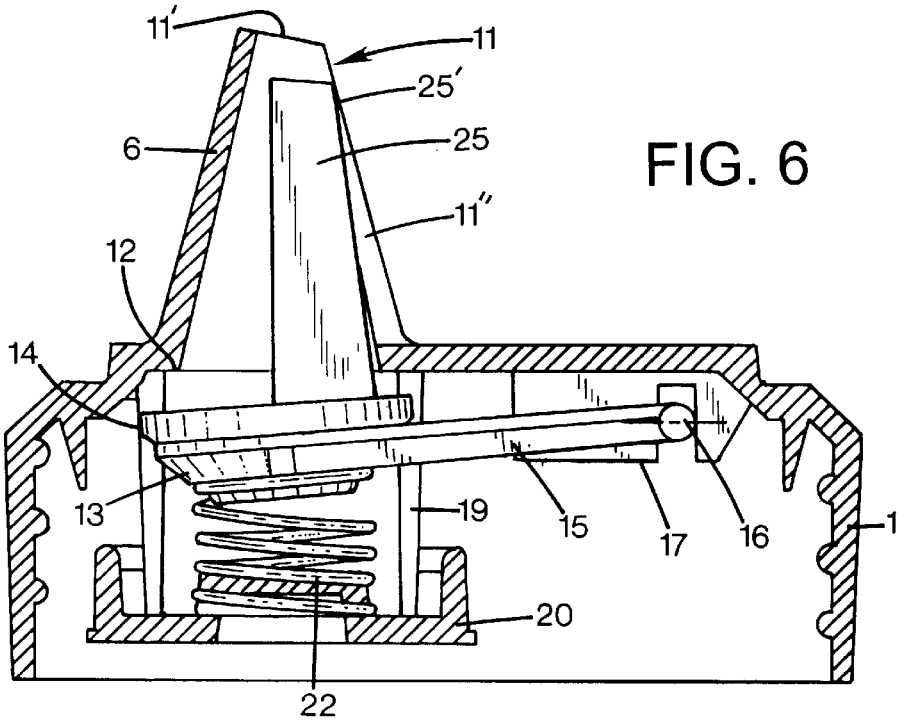

On embodiment form of the invention is hereinafter described in more detail by way of the appended drawings. In the drawings there are shown:

FIG. 1*a* to *c* the spill-protecting top on a drinking vessel with a cap placed on below, in a front view (FIG. 1*a*), a plan view (FIG. 1*b*) and a view from below (FIG. 1*c*);

FIG. 2 the same embodiment form with a cap placed on below in a front view rotated somewhat about the longitudinal axis;

FIGS. 3*a* to *c* the same embodiment form with a cap placed on below in a front view in the same position as with FIG. 1*a* (FIG. 3*a*), in a plan view (FIG. 3*b*) and a view from below (FIG. 3*c*);

FIG. 4 the same embodiment form with a cap placed on above in a somewhat rotated front view;

FIG. 5 the same top with a closure body in the blocking position in an enlarged longitudinal section;

FIG. 6 the same top with a closure body in the admission position in the same section as FIG. 5.

In the drawings the spill-protecting top is indicated at 1, the drinking beaker at 2 and the cap at 3.

As can be seen from the FIGS. 1 and 2 the top 1 is formed as a screw lid with a floor 4 and with a circumferential casing 5. In the region of the circumferential casing 5 it is screwed to the drinking vessel 2. Externally a suction spout 6 is seated eccentrically on the floor. Further the top 1 externally on the floor has an approximately rectangular shoulder 7 with rounded corners which serves the placing on the cap 3. In these drawings the cap 3 is however placed onto the drinking vessel 2 underneath.

The FIGS. 3 and 4 show the cap 3 on the shoulder 7 of the top 1. Here it can also be seen that the drinking beaker 2 in the vicinity of the floor comprises a shoulder 7' which permits a placing of the cap 3 onto the drinking beater 2 underneath. The dimensions of the cap 3 and of the shoulders 7,7' are matched to one another such that the cap 3 in its respective placed-on position has a press fit and is unlosably connected to the top 1 or the drinking vessel 2.

Furthermore the FIGS. 1 to 4 show that the shoulder top 1, the drinking vessel 2 as well as the cap 3 have flattenings or bevelings which increase the ability to grip and codetermine the aesthetic picture of appearance.

According to FIGS. 5 and 6 at the inner circumference of the circumferential casing 5 of the top 1 there is present an inner thread 8 which cooperates with a corresponding outer thread of the drinking beaker 2. In the transition region of the circumference casing 5 and the floor 4 in the top there circles a sealing lip 9 which is formed integrally with the top 1 and cooperates with the inner edge of the opening above on the drinking vessel 2. The top is manufactured of a plastic and the sealing lip 9 has a certain elasticity so that it may sealingly bear on the inner edge of the drinking beaker under pretensioning.

In the shown section the walls of the suction spout 6 coverage towards their free end 10. Perpendicular to the plane of the drawing the width of the suction spout 6 is essentially constant (cf. FIG. 1*b*).

The suction spout 6 has an opening 11 which is partly arranged in the region of the free end 10 and here is indicated at 11' and partly in the region of a wall through which the cross section of FIGS. 5 and 6 run and here is indicated at 11'. Its section 11' extends perpendicular to the plane of the drawing practically over the whole width of the suction spout 6 (cf. FIG. 1*b*). The section 11" is only formed slot-shaped in the lateral wall, thus has a smaller width than the section 11'(cf. FIG. 1*b*). The free end 10 is beveled towards the section 11" of the opening 11.

The edge of the opening of the suction spout 6 on the inner side of the floor 4 forms a sealing seat 12, against which according to FIG. 5 a plate-shaped closure body 13 with a circumferential sealing region 14 presses. The closure body 13 is fixed at the end of a one-armed lever 15 which is pivotally mounted on the inner side of the floor 4 with a peg 16 in a bearing 17. The peg 16 is inserted into a groove 18 of the bearing 17 so that the lever 15 can be disassembled with the closure body 13.

From the inner side of the floor there protrudes a sleeve-shaped retaining element 19 which surrounds the sealing seat 12. The retaining element 19 has—not shown—passages for fluid. Below it carries a plate-shaped counter bearing 20 in the form of a cap which with its casing is releasably clamped onto the sleeve-shaped retaining element 19 at 21. For this the sleeve-shaped retaining element 19 and the cap 20 have a certain elasticity.

On the counter bearing 20 there is supported a helical spring 22 which presses against the lower side of the closure body 13 and loads this towards the sealing seat 12. The helical spring 22 on the inside is guided on shoulders 23 of the counter bearing 20 and 24 of the closure body 13.

On the upper side the plate-shaped closure body 13 carries a rod-like projection 25 which extends through the sealing seat 12 into the suction spout 6 and reaches up to the free end 10 thereof. Between the suction spout 6 and the projection 25 on the side distant to the section 11" of the opening 11 there is present a free space. The projection 25 intersects the section 11' of the opening at an acute angle and projects into the upper section of the opening with an actuation section 25' somewhat out of this opening.

The valve formed by the sealing seat 12 and the closure body 13 may be opened from the outside by actuating the actuation section 25'. According to FIG. 6 specifically a pressure against the side of the actuation section 25', which laterally protrudes out of the suction spout 6, effects a pivoting of the projection 25, by which means in turn the closure body 13 is pivoted away from the sealing seal 12 against the effect of the helical spring 22. After unloading the actuation section 25' the closure body 13 on account of the effect of the spring 22 returns into its blocking position on the sealing seat 12.

Thus the valve may be opened in that the user encloses the suction spout 6 with his lips so that one lip actuates the actuation section 25'. When the drinking vessel 2 is tilted up then the fluid flows out of the suction spout under the influence of gravity. After the drinking the valve closes automatically and an unintentional spilling of the fluid is prevented. Since the actuation section 25' faces the middle axis of the container, unintentional actuation by way of external force effects already area largely prevented. An actuation is completely impossible when the cap 3 is placed onto the top 1 and covers the suction spout 6.

On drinking, air may flow through the suction spout or through an additional opening in the top 1 or the drinking vessel 2, which is not shown.

For cleaning the top 1 may be completely disassembled.

What is claimed is:

1. A spill-protecting lid for a drinking vessel, comprising:

the lid having an opening defined therein, the lid defining a sealing seat;

a suction spout disposed at the opening, the suction spout being in fluid communication with a fluid contained in the drinking vessel;

a closure body being urged against the sealing seat by a spring element into a closed position to close the opening, the closure body being movable into an open position to open the opening by moving the closure body away from the sealing seat against a biasing force of the spring element; and a projection attached to the closure body and projecting into the suction spout, the projection having an actuation section for moving the closure body between the closed position and the open position.

2. The spill-protecting lid according to claim 1 wherein the suction spout has a free end forming a spout opening.

3. The spill-protecting lid according to claim 2 wherein the spout opening is partly defined by the suction spout and the projection.

4. The spill-protecting lid according to claim 2 wherein the suction spout converges toward the free end thereof.

5. The spill-protecting lid according to claim 1 wherein the suction spout defines a lateral groove at one side of the suction spout.

6. The spill-protecting lid according to claim 5 wherein the projection is rod shaped and intersects the lateral groove at an acute angle when the closure body is in the closed position.

7. The spill-protecting lid according to claim 1 wherein the projection has an actuation section that projects laterally out of the opening.

8. The spill-protecting lid according to claim 1 wherein the sealing seat is circumferential and the closure body is biased against the sealing seat and the projection projects through the sealing seat.

9. The spill-protecting lid according to claim 1 wherein the closure body is plate shaped and the closure body has a circumferential portion that is pressed against the sealing seat.

10. The spill-protecting lid according to claim 1 wherein the closure body is secured to a lever.

11. The spill-protecting lid according to claim 1 wherein the sealing seat is disposed on an inside of a wall supporting the suction spout.

12. The spill-protecting lid according to claim 11 wherein a spring element is captured between the closure body and a counter bearing disposed inside the lid.

13. The spill-protecting lid according to claim 12 wherein the counter bearing is secured to a sleeve shaped retaining element that is attached to an inner side of the wall.

14. The spill-protecting lid according to claim 12 wherein the counter bearing is a plate shaped element that is releasably attached to a retaining element.

15. The spill-protecting lid according to claim 14 wherein the spring element is a helical spring.

16. The spill-protecting lid according to claim 15 wherein the helical spring has an upper end that is guided by a shoulder defined in the closure body and by a shoulder defined in the counter bearing.

17. The spill-protecting lid according to claim 1 wherein the projection has smooth edges and is made by a biocompatible material.

18. The spill-protecting lid according to claim 1 wherein the lid further comprises a cap-receiving shoulder and a cap is releasably attached to the cap-receiving shoulder.

19. The spill-protecting lid according to claim 18 wherein the cap-receiving shoulder is adjacent a wall of the lid.

20. The spill-protecting lid according to claim 1 wherein the lid further comprises a cylindrical circumferential outer wall.

21. The spill-protecting lid according to claim 1 wherein the lid is screwed onto the drinking vessel.

22. The spill-protecting lid according to claim 1 wherein a sealing element is disposed between the lid and the drinking vessel.

23. The spill-protecting lid according to claim 22 wherein the sealing element is integrally formed with the lid.

24. The spill-protecting lid according to claim 1 wherein the drinking vessel is a beaker.

25. The spill-protecting lid according to claim 1 wherein the lid is integrally formed with the drinking vessel.

26. The spill-protecting lid according to claim 1 wherein the projection is attached to the closure body to pivot the closure body relative to the sealing seat.

* * * * *